US008729876B2

(12) United States Patent
Shen

(10) Patent No.: US 8,729,876 B2
(45) Date of Patent: May 20, 2014

(54) VOLTAGE REGULATOR AND RELATED VOLTAGE REGULATING METHOD THEREOF

(75) Inventor: Chia-Jui Shen, Tainan County (TW)

(73) Assignee: Himax Technologies Limited, Fonghua Village, Xinshi Dist., Tainan (TW)

( * ) Notice: Subject to any disclaimer, the term of this patent is extended or adjusted under 35 U.S.C. 154(b) by 387 days.

(21) Appl. No.: 12/692,641

(22) Filed: Jan. 24, 2010

(65) Prior Publication Data

US 2011/0181259 A1 Jul. 28, 2011

(51) Int. Cl.
*G05F 1/00* (2006.01)

(52) U.S. Cl.
USPC ..... 323/274

(58) Field of Classification Search
USPC ..... 323/268, 269, 273–275, 311, 315–317
See application file for complete search history.

(56) References Cited

U.S. PATENT DOCUMENTS

| | | | | |
|---|---|---|---|---|
| 6,362,609 | B1 * | 3/2002 | Gailhard | 323/280 |
| 6,806,690 | B2 * | 10/2004 | Xi | 323/273 |
| 7,218,168 | B1 * | 5/2007 | Rahman | 327/540 |
| 2008/0191670 | A1 * | 8/2008 | Oddoart et al. | 323/273 |

FOREIGN PATENT DOCUMENTS

| | | |
|---|---|---|
| TW | 299940 | 3/1997 |
| TW | 529219 | 4/2003 |
| TW | I244251 | 11/2005 |
| TW | 200615728 | 5/2006 |
| TW | 200944978 | 11/2009 |

* cited by examiner

*Primary Examiner* — Jue Zhang
(74) *Attorney, Agent, or Firm* — Winston Hsu; Scott Margo

(57) ABSTRACT

A voltage regulator includes: a first comparator for comparing a first reference voltage with a feedback voltage to generate a first comparing result accordingly; a first transistor for controlling an output voltage at an output node in response to the first comparing result; a second transistor for adjusting the output voltage at the output node in response to a control signal; a feedback block, for providing the feedback voltage according to the output voltage; and a control block, for receiving the output voltage and providing the control signal according to the output voltage.

13 Claims, 6 Drawing Sheets

VOLTAGE REGULATOR AND RELATED VOLTAGE REGULATING METHOD THEREOF

BACKGROUND OF THE INVENTION

1. Field of the Invention

The present invention relates to generating a regulated voltage, and more particularly, to a novel voltage regulator (e.g., an LDO regulator) which maintains excellent output voltage stability with a capacitor-free structure.

2. Description of the Prior Art

Linear regulators are used in modern electronic systems for providing efficient power-management capability. One of the most commonly used linear regulators is a low dropout regulator.

Please refer to FIG. 1. FIG. 1 is a diagram illustrating a conventional low dropout regulator 100. The conventional low dropout regulator 100 includes an error amplifier 110, a driving PMOS 120 (used as a passing element), a feedback circuit 130, and a load capacitor 140. The error amplifier 110 is coupled to a reference voltage source for receiving a reference voltage $V_{REF}$ to compare the reference voltage $V_{REF}$ with a feedback voltage $V_{FB}$, and the reference voltage source can be a bandgap voltage reference source. As shown in FIG. 1, the voltage level of the feedback voltage $V_{FB}$ is proportional to the voltage level of the output voltage $V_{OUT}$ with reference to the respective resistive values of the plurality of resistors which make up the feedback circuit 130. In FIG. 1, the feedback circuit 130 is constructed by a first resistor $R_1$ and a second resistor $R_2$. The error amplifier 110 magnifies the voltage difference between the reference voltage $V_{REF}$ and the feedback voltage $V_{FB}$ and controls the driving PMOS 120 to output the output voltage $V_{OUT}$.

Therefore, conventionally, for ensure the output stability; a load capacitor 140 is required to compensate the voltage drop at the output node 150. However, due to its large size, the load capacitor 140 exorbitantly increases the required circuitry area and costs.

A new low dropout regulator is therefore desired to promote stability whilst giving consideration to the area and cost issue.

SUMMARY OF THE INVENTION

It is therefore one of the objectives of the present invention, to provide a voltage regulator capable of compensating the transient voltage drop at the output node without using an external capacitor and related method thereof.

According to a first exemplary embodiment of the present invention, a voltage regulator is provided. The voltage regulator comprises: a first comparator, a first transistor, a second transistor, a feedback block, and a control block. The first comparator has a first end coupled to a first reference voltage and a second end coupled to a feedback voltage, and the first transistor compares the first reference voltage with the feedback voltage to generate a first comparing result accordingly. The first transistor has a control end for receiving the first comparing result, a first end coupled to a supply voltage, and a second end coupled to an output node of the voltage regulator, wherein the first transistor controls an output voltage at the output node in response to the first comparing result. The second transistor has a control end for receiving a control signal, a first end coupled to the supply voltage, and a second end coupled to the output node, wherein the second transistor adjusts the output voltage at the output node in response to the control signal. The feedback block is coupled between the second end of the first comparator and the output node, and the feedback block provides the feedback voltage according to the output voltage. The control block is coupled between the control end of the second transistor and the output node, and the control block receives the output voltage and provides the control signal according to the output voltage.

According to a second exemplary embodiment of the present invention, a voltage regulating method is provided. The voltage regulating method comprises: comparing a first reference voltage with a feedback voltage to generate a first comparing result accordingly; utilizing a first transistor to control an output voltage at an output node in response to the first comparing result;

utilizing a second transistor to adjust the output voltage at the output node in response to a control signal; providing the feedback voltage according to the output voltage; and providing the control signal according to the output voltage.

According to a third exemplary embodiment of the present invention, a voltage regulator is provided. The regulator comprises a voltage regulating circuit and a compensation block. The voltage regulating circuit regulates an output voltage at an output node according to a feedback voltage derived from the output voltage. The compensation block is coupled to the output node of the voltage regulating circuit and the compensation block receives the output voltage and selectively compensates the output voltage according to the output voltage.

These and other objectives of the present invention will no doubt become obvious to those of ordinary skill in the art after reading the following detailed description of the preferred embodiment that is illustrated in the various figures and drawings.

DETAILED DESCRIPTION

Certain term are used throughout the following description and claims in reference to particular system components. As one skilled in the art will appreciate, manufacturers may refer to a component by different names. This document does not intend to distinguish between components that differ in name but not function. In the following discussion and in the claims, the terms "including" and "comprising" are used in an open-ended fashion, and thus should be interpreted to mean "including, but not limited to . . . . " The terms "couple" and "couples" are intended to mean either an indirect or a direct electrical connection. Thus, if a first device couples to a second device, that connection may be through a direct electrical connection, or through an indirect electrical connection via other devices and connections.

Figure 1:
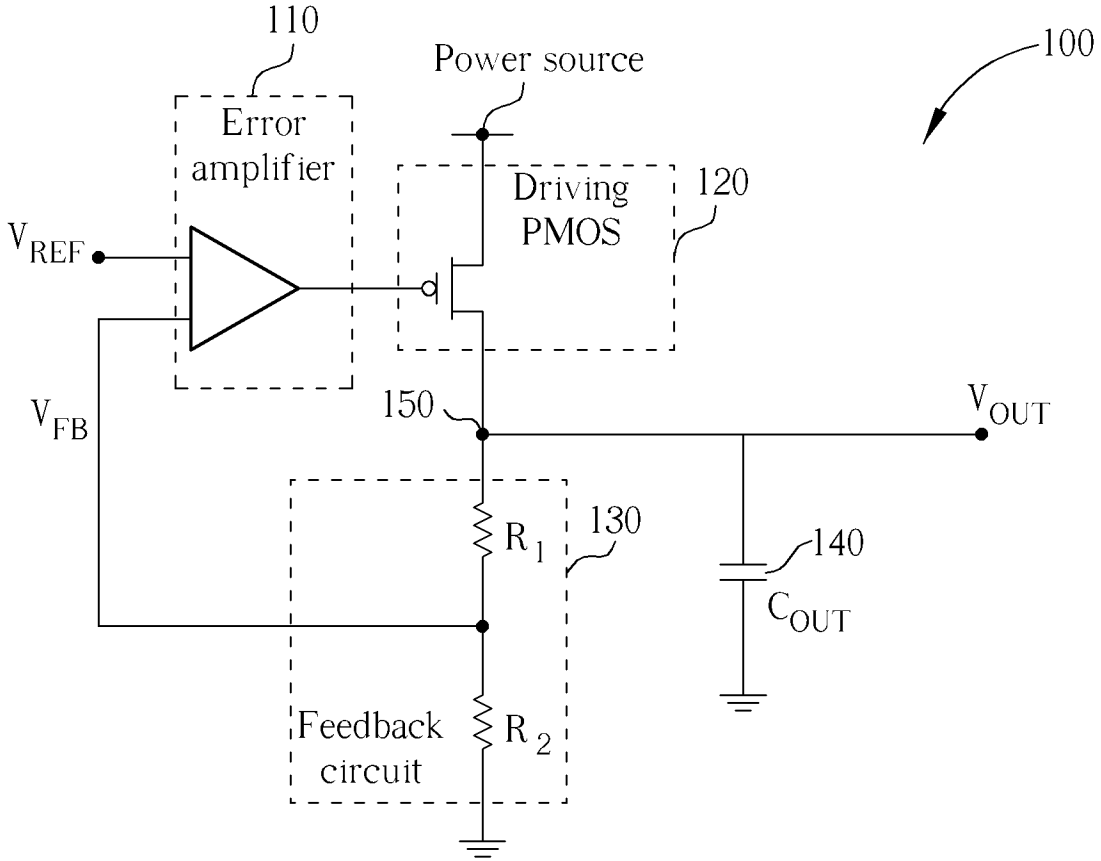
FIG. 1 PRIOR ART
FIG. 1 is a diagram illustrating a conventional low dropout regulator.
Figure 2:
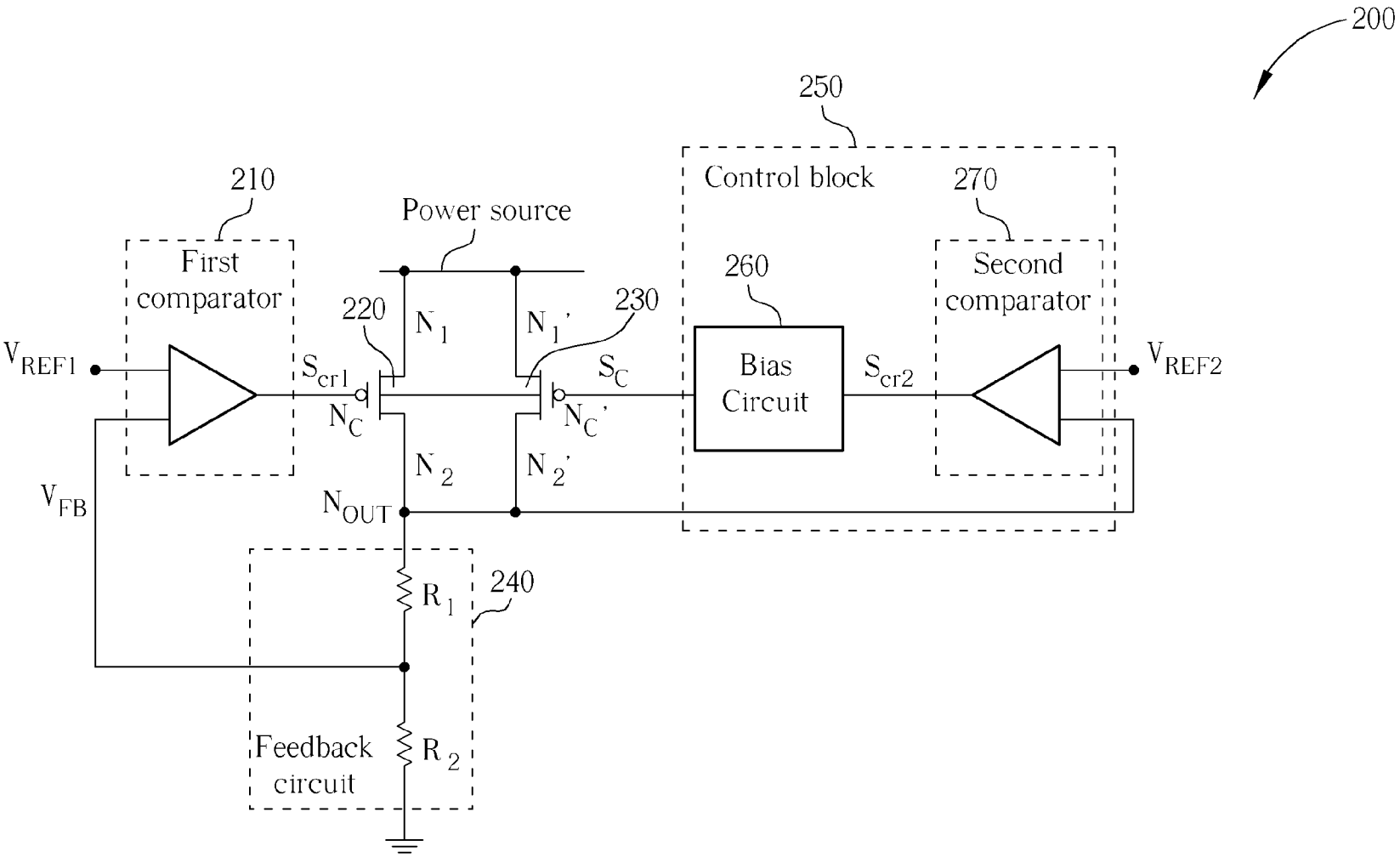
FIG. 2 is a diagram illustrating a low dropout regulator according to a first exemplary embodiment of the present invention.

Please refer to FIG. 2. FIG. 2 is a diagram illustrating a low dropout regulator 200 according to a first exemplary embodiment of the present invention. The dropout regulator 200 includes a first comparator 210, a first transistor 220, a second transistor 230, a feedback block 240, and a control block 250. A first end of the first comparator 210 is coupled to a first reference voltage source for receiving a first reference voltage $V_{REF1}$ and a second end of the first comparator 210 is used to receive a feedback voltage $V_{FB}$. In addition, the first comparator 210 is coupled to a control end $N_C$ of the first transistor 220, to compare the first reference voltage $V_{REF1}$ with the feedback voltage $V_{FB}$ to output a first comparing result $S_{CR1}$ accordingly and thereby control the first transistor 220. The first transistor 220 has a first end $N_1$ coupled to a power source and receives a supply voltage. A control end $N_C$ of the first transistor 220 receives the first comparing result $S_{CR1}$ outputted from the first comparator 210, and a second end of the first transistor 220 is coupled to an output node $N_{OUT}$. The first transistor 220 is a P-channel metal-oxide-semiconductor field-effect transistor (PMOSFET) and controls an output voltage according to the control of the first comparator 210. The feedback block 240 can be formed by a plurality of resistors such as resistors $R_1$ and $R_2$, to generate a divided voltage of the output voltage as the feedback voltage $V_{FB}$.

As shown in FIG. 2, the second transistor 230 has a first end $N_{1'}$, a second end $N_{2'}$, and a control end $N_{C'}$ to couple between the power source, the output node $N_{OUT}$, and the control block 250 respectively. The control block 250, coupled between the control end $N_{C'}$ of the second transistor 230 and the output node $N_{OUT}$, forms an additional feedback loop, and operates to receive the output voltage and generate a control signal $S_C$. To explain more clearly, the control block 250 has a first end coupled to a second reference voltage source (not shown) to receive a second reference voltage $V_{REF2}$, and a second end to receive the output voltage. The control block 250 provides the control signal $S_C$ to the second transistor 230 according to the second reference voltage $V_{REF2}$ and the output voltage, and thereby is capable of selectively compensating the output voltage when a current sink occurs at the output node $N_{OUT}$. The second transistor 230 is allowed to adjust/compensate the voltage level of the output voltage in accordance with the control signal $S_C$ generated by the control block 250, thus maintaining the output stability of the low dropout regulator 200.

Compared to the related art, by applying the new circuit structure, the instant voltage drop of the output voltage due to occurrence of an instantaneous current sink is successfully compensated without necessitating a large-size capacitor.

In this exemplary embodiment, the second transistor 230 is a PMOSFET, and the control block 250 can be further divided into a bias circuit 260 and a second comparator 270. The second comparator 270 is coupled to the second reference voltage $V_{REF2}$ and the output node $N_{OUT}$ by a first node and a second node, respectively, for comparing the second reference voltage $V_{REF2}$ with the output voltage and outputting a second comparing result $S_{cr2}$ accordingly. In addition, the control block 250 uses a bias circuit 260 to control outputting of the control signal $S_C$ according to the second comparing result $S_{cr2}$. The structures and operational details of the bias circuit 260 and the second comparator 270 will be disclosed in subsequent descriptions. However, the structures of the bias circuit and the second comparator are not meant to be a limitation of the present invention since any low dropout regulators possessing a control block capable of reducing the instant voltage drop of the output voltage caused by an instant current sink at the output node $N_{OUT}$ by controlling the second transistor according to the output voltage obeys and falls within the scope of the present invention.

Figure 3:
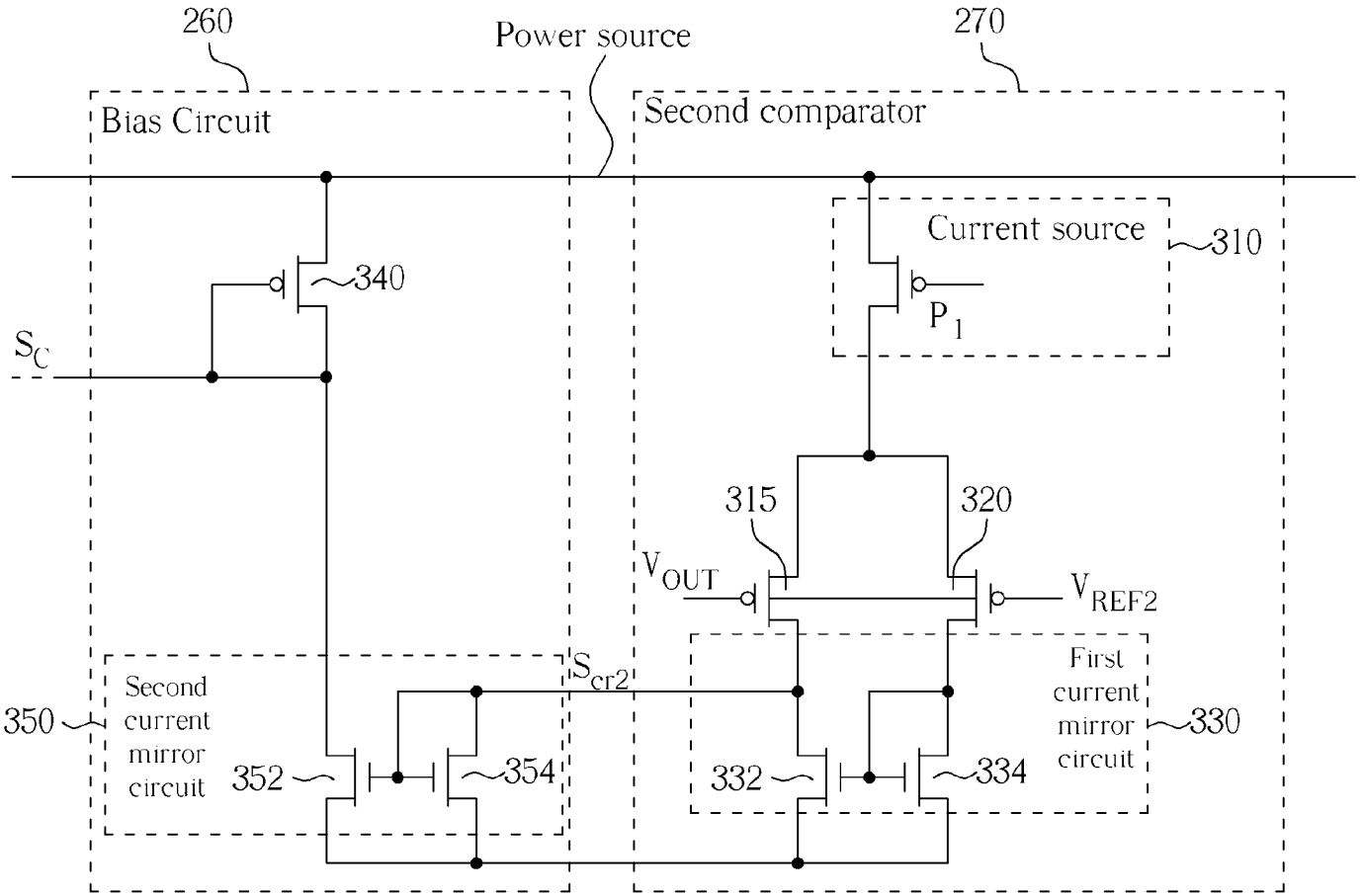
FIG. 3 is an exemplary embodiment of the bias circuit and the second comparator shown in FIG. 2.

Please refer to FIG. 3 in conjunction with FIG. 2. FIG. 3 is an exemplary embodiment of the bias circuit 260 and the second comparator 270 in FIG. 2. The second comparator 270 has a PMOSFET P1 coupled to a power source serving as a current source 310 and is further coupled to a first end of a third transistor 315 as well as a first end of the fourth transistor 320. The third transistor 315 has a control end coupled to the output node $N_{OUT}$ for receiving the output voltage $V_{OUT}$ and a second end of the third transistor 315 is coupled to the bias circuit 260 for outputting the second comparing result $S_{CR2}$. The fourth transistor 320 has a control end coupled to the second reference voltage source (not shown) for receiving the second reference voltage $V_{REF2}$, where both the second ends of the third transistor 315 and the fourth transistor 320 are coupled to a first current mirror circuit 330. The third transistor 315 and the fourth transistor 320 are PMOSFETs and the first current mirror circuit 330 is composed of two n-channel MOSFETs (NMOSFETs) 332 and 334. When a large voltage drop occurs at the output node $N_{OUT}$/the second comparator 270 senses the voltage drop of the output voltage $V_{OUT}$ and outputs the second comparing result $S_{CR2}$, where the second comparing result $S_{CR2}$ is a current signal to activate the bias circuit 260. The bias circuit 260 is composed of a fifth transistor 340 and a second current mirror circuit 350. The second current mirror circuit 350 has a first current path passing through an NMOSFET 354 and a second current path passing through another NMOSFET 352. The fifth transistor 340 is a PMOSFET with a first end coupled to the power source, and a second end of the fifth transistor 340 coupled to a control end of the fifth transistor 340. When the voltage level of the output voltage $V_{OUT}$ is smaller than that of the second reference voltage $V_{REF2}$, the second comparing result $S_{CR2}$ is received by the bias circuit 260 and the NMOSFET 354 is turned on. In the second current mirror circuit 350, a current passing through the NMOSFET 354 (i.e., current passing through the first current path) will be mirrored to the NMOSFET 352. The current mirror circuits and the operational details are well known by people skilled in this art, therefore further description is omitted here for the sake of brevity. Moreover, since the fifth transistor 340 is coupled to the second transistor 230 (FIG. 2), when the voltage level of the output voltage $V_{OUT}$ is smaller than that of the second reference voltage $V_{REF2}$, the second comparator 270 and the bias circuit 260 are activated to use the control signal $S_C$ for controlling the second transistor 230 in order to reduce the voltage drop of the output voltage $V_{OUT}$. In other words, by using the control signal $S_C$ to control the current magnitude passing through the second transistor 230, the voltage drop at the output node $N_{OUT}$ is rapidly compensated. In this way, the present invention presents a capacitor-free low dropout regulator which uses a control block to adjust/compensate the output voltage $V_{OUT}$ at the output node according to the output voltage $V_{OUT}$. In the aforementioned embodiment, the supplied voltage of the second reference voltage source is different from that of the first reference voltage source. However, with appropriate adjustments, the output of the second reference voltage source is allowed to be the same as the first reference voltage source when a voltage-dividing circuit is further used to receive the first reference voltage and derives the required second reference voltage which is smaller than the first reference voltage. The aforementioned exemplary embodiments are for illustrative purposes only and all the low dropout regulators which use a control block to receive the output voltage $V_{OUT}$ and provide the control signal $S_C$ in accordance with the output voltage $V_{OUT}$ to thereby reduce the output voltage drop at the output node $N_{OUT}$ also obey and fall within the scope of the present invention.

Figure 4:
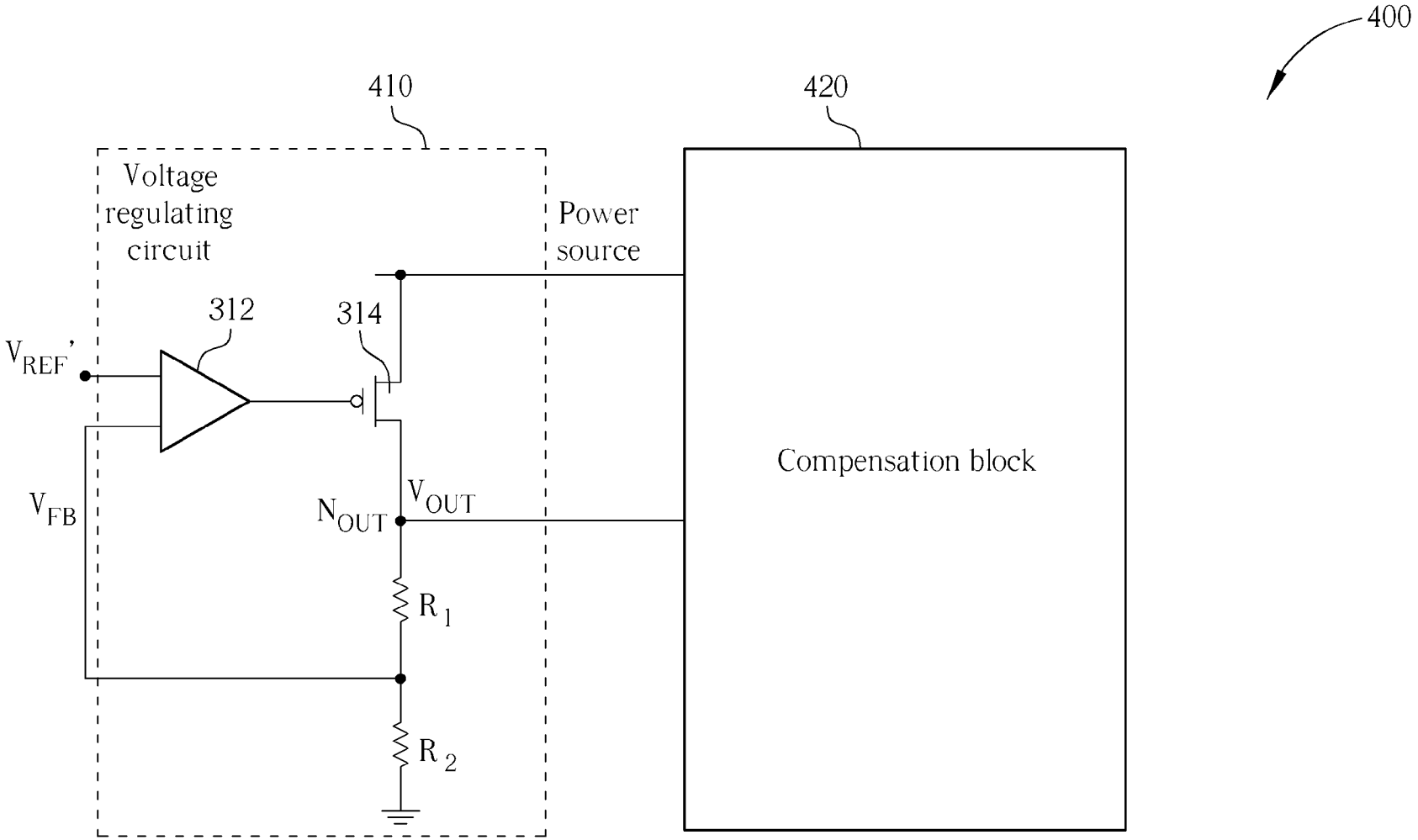
FIG. 4 is a diagram illustrating a regulator according to a second exemplary embodiment of the present invention.

Please refer to FIG. 4. FIG. 4 is a diagram illustrating a regulator according to a second exemplary embodiment of the present invention. A regulator 400 includes a voltage regulating circuit 410 and a compensation block 420. The voltage regulating circuit 410 is composed of a comparator 312, a transistor 314, a first resistor $R_1$ and a second resistor $R_2$, wherein the first resistor R1 and the second resistor $R_2$ are used to provide a feedback voltage $V_{FB}$ relative to an output voltage $V_{OUT}$ at an output node $N_{OUT}$. The voltage regulating circuit 410 receives a reference voltage $V_{REF}$, and a feedback voltage $V_{FB}$ in order to regulate the output voltage $V_{OUT}$ accordingly. Since the operation and structures of the voltage regulating circuit 410 are similar to that of the first comparator 210, the first transistor 220 and the feedback block 240 given in FIG. 2; further descriptions are omitted here for the sake of brevity. The compensation block 420, as shown in FIG. 4, is coupled to the power source and the output node $N_{OUT}$ of the voltage regulating circuit 410, and the compensation block 420 can be used to replace the conventional load capacitor to maintain the stability of the regulator. For instance, the compensation block 420 is active when the output voltage $V_{OUT}$ has a voltage drop, and selectively compensates the voltage level of the output voltage $V_{OUT}$ according to the output voltage $V_{OUT}$. The structure and operational details of the compensation block 420 will be disclosed in the subsequent descriptions.

Figure 5:
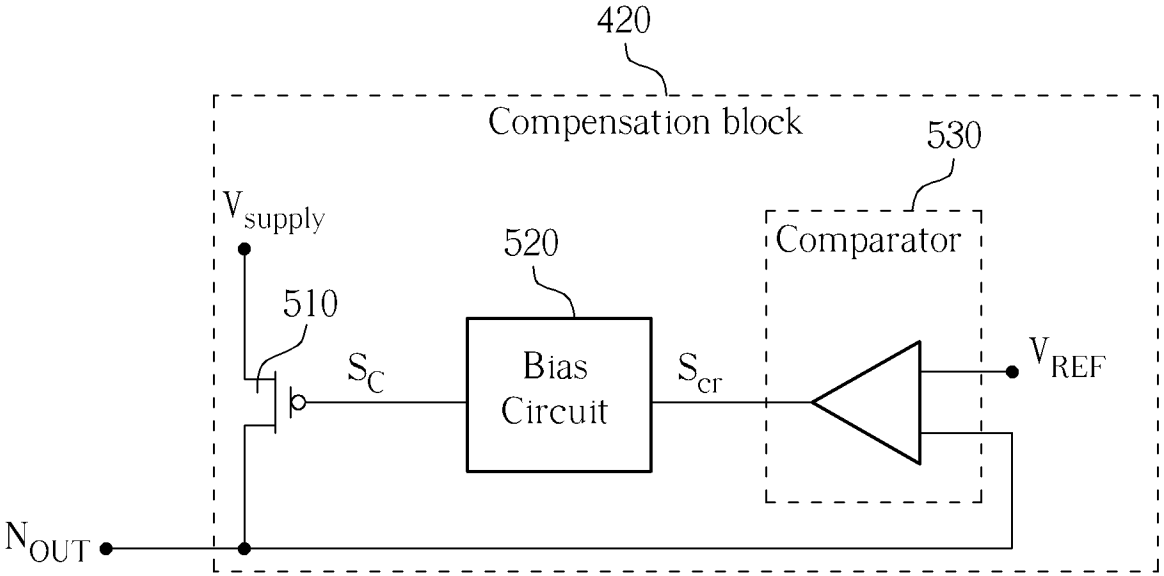
FIG. 5 is a diagram illustrating an exemplary embodiment of the compensation block shown in FIG. 4.

Please refer to FIG. 5 in conjunction with FIG. 4. FIG. 5 is a diagram illustrating an exemplary embodiment of the compensation block 420 in FIG. 4. The compensation block 420 is composed of a first transistor 510, a bias circuit 520 and a comparator 530. The first transistor 510 has a first end for receiving a supply voltage $V_{Supply}$, a second end coupled to the output node $N_{OUT}$, and a control node to receive a control signal $S_C$. The first transistor 510 can be configured by a PMOSFET, and the first transistor 510 adjusts the output voltage $V_{OUT}$ at the output node $N_{OUT}$ in response to the control signal $S_C$. The comparator 530 has a first end for receiving a reference voltage $V_{REF}$, a second end coupled to the output node $N_{OUT}$ for receiving the output voltage $V_{OUT}$, and an output node to output a comparing result $S_{cr}$ which corresponds to reference voltage $V_{REF}$ and the output voltage $V_{OUT}$. The bias circuit 520, coupled to the comparator 530 and the control end of the first transistor 510, provides the control signal $S_C$ to control the operation of the first transistor 510 in accordance with the comparing result $S_{cr}$.

Figure 6:
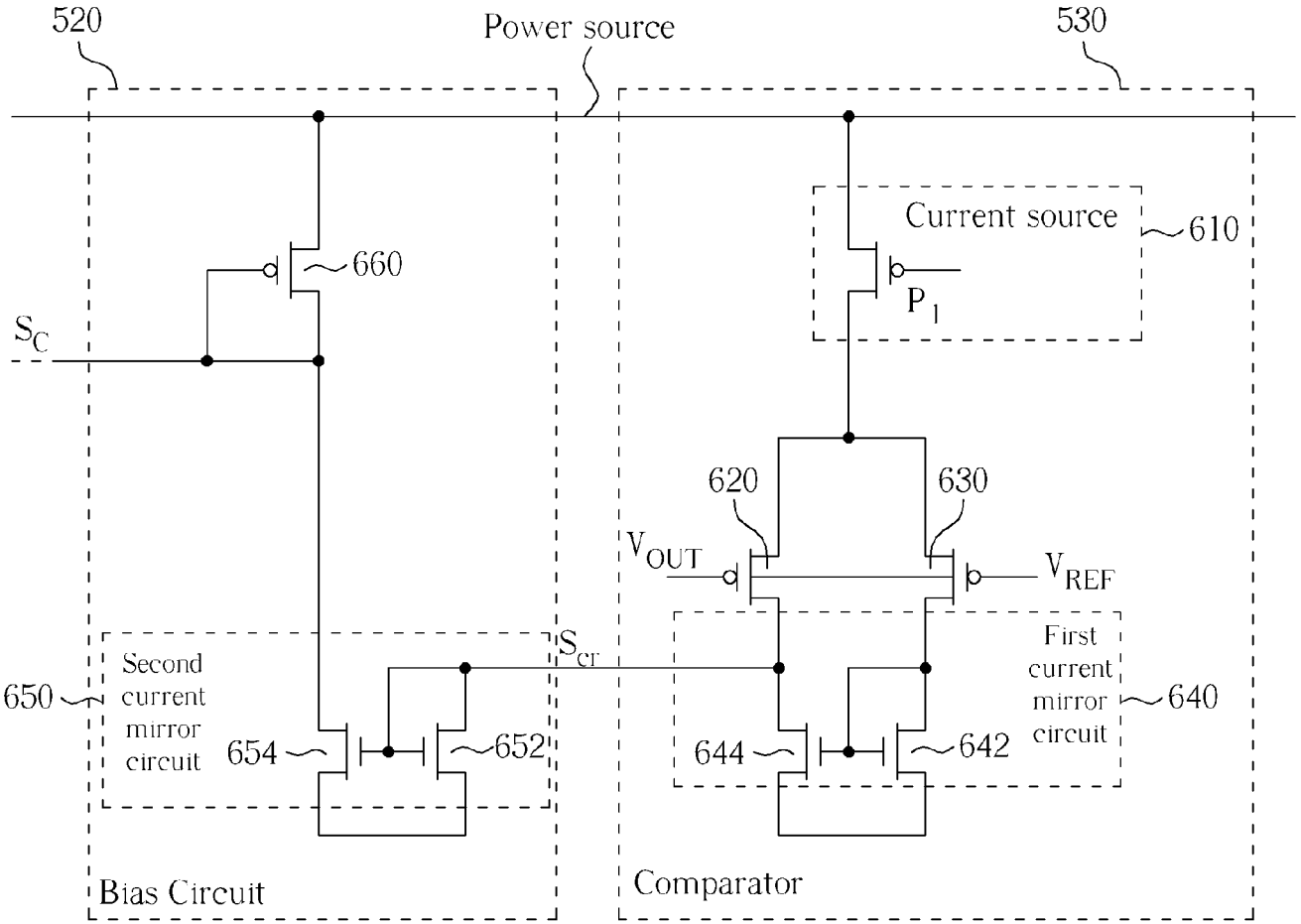
FIG. 6 is an exemplary embodiment of the bias circuit and the comparator shown in FIG. 5.

A detailed embodiment of the bias circuit 520 and the comparator 530 of the compensation block 420 are disclosed in the following. Please refer to FIG. 6 in conjunction with FIG. 5. FIG. 6 is an exemplary embodiment of the bias circuit 520 and the comparator 530 shown in FIG. 5. In this embodiment, the comparator 530 is composed of a current source 610, a second transistor 620, a third transistor 630, and a first current mirror circuit 640. The current source 610 herein can be implemented by a PMOSFET $P_1$ coupled to the power source. The second transistor 620 has a first end coupled to the current source 610, a control end coupled to the output node $N_{OUT}$ for receiving the output voltage $V_{OUT}$, and a second end coupled to the bias circuit 520. The third transistor 630 has a control end coupled to the reference voltage $V_{REF}$, a first end coupled to the first end of the second transistor 620, and a second end; wherein both the second ends of the second transistor 620 and of the third transistor 630 are coupled to the first current mirror circuit 640. The first current mirror circuit 640 is composed of two NMOSFETs 642 and 644, and the first current mirror circuit 640 has a first current path coupled to the second end of the second transistor 620 and a second current path coupled to the second end of the third transistor 630. By applying the current mirror technology, once the voltage level of the output voltage $V_{OUT}$ is smaller than that of the reference voltage $V_{REF}$, the comparing result $S_{cr}$ is transmitted to the bias circuit 520 and controls the bias circuit 520 to output the control signal $S_C$ accordingly. The bias circuit 520 has a second current mirror circuit 650 and a fourth transistor 660. The second current mirror 650 has a first current path coupled to the second end of the second transistor 620, and a second current path. The fourth transistor 660 has a first end coupled to the power source, a second end coupled to the control end of the fourth transistor 660 and coupled to the second current path of the second current mirror circuit 650. When the comparator 530 outputs the comparing result $S_{cr}$ to the bias circuit 520, the transistor 652 is turned on and a current passing through the transistor 652 will be mirrored to the other transistor 654, wherein the two transistors 652 and 654 can be implemented by NMOSFETs. Since the current mirror circuits and the operational details are well known by people skilled in this art, further descriptions are omitted here for the sake of brevity. In addition, since the fourth transistor 660 is coupled to the first transistor 510 (FIG. 5), when the voltage level of the output voltage $V_{OUT}$ is smaller than that of the reference voltage $V_{REF}$, the comparator 530 and the bias circuit 520 will be active to use the control signal $S_C$ for controlling the first transistor 510 to reduce the voltage drop of the output voltage $V_{OUT}$. In this way, the present invention provides a capacitor-free regulator which uses a compensation block to adjust/compensate the output voltage $V_{OUT}$ at the output node $N_{OUT}$ according to the output voltage $V_{OUT}$ when there is a voltage drop at the output voltage $V_{OUT}$. The aforementioned exemplary embodiments are for illustrative purposes only and all regulators using a compensation block to receive the output voltage $V_{OUT}$ and provide the control signal $S_C$ according to the output voltage $V_{OUT}$ to thereby reduce the output voltage drop at the output node $N_{OUT}$ obey and fall within the scope of the present invention.

Those skilled in the art will readily observe that numerous modifications and alterations of the device and method may be made while retaining the teachings of the invention.

What is claimed is:

1. A voltage regulator, comprising:

a first comparator, having a first end coupled to a first reference voltage and a second end coupled to a feedback voltage that is generated at a node of a resistor network, for comparing the first reference voltage with the feedback voltage to generate a first comparing result accordingly;

a first transistor, having a control end for receiving the first comparing result, a first end coupled to a supply voltage, and a second end coupled to an output node of the voltage regulator, wherein the first transistor controls an output voltage at the output node in response to the first comparing result;

a second transistor, having a control end for receiving a control signal, a first end coupled to the supply voltage, and a second end coupled to the output node, wherein the second transistor adjusts the output voltage at the output node in response to the control signal;

a feedback block, coupled between the second end of the first comparator and the output node, for providing the feedback voltage according to the output voltage; and a control block, coupled between the control end of the second transistor and the output node, for receiving the output voltage and providing the control signal according to the output voltage, wherein when the output voltage has a voltage drop, the control block is operative to generate the control signal to control the second transistor to increase a voltage level of the output voltage for reducing the voltage drop only.

2. The voltage regulator of claim 1, wherein the control block comprises:

a second comparator, having a first end for receiving a second reference voltage and a second end coupled to the output node, the second comparator for comparing the output voltage with the second reference voltage to generate a second comparing result; and a bias circuit, coupled to the second comparator and the second transistor, for providing the control signal to the second transistor according to the second comparing result.

3. The voltage regulator of claim 2, wherein the second comparator comprises:

a current source, for providing a reference current;

a third transistor, having a control end for receiving the output voltage, a first end coupled to the current source, and a second end coupled to the bias circuit;

a fourth transistor, having a control end for receiving the second reference voltage, a first end coupled to the first end of the third transistor, and a second end; and a first current mirror circuit, having a first current path coupled to the second end of the third transistor and a second current path coupled to the second end of the fourth transistor.

4. The voltage regulator of claim 3, wherein the bias circuit comprises:

a second current mirror circuit, having a first current path coupled to the second end of the third transistor, and a second current path; and a fifth transistor, having a control end, a first end coupled to the supply voltage, and a second end coupled to the control end of the fifth transistor, the second current path of the second current mirror circuit, and the control end of the second transistor.

5. The voltage regulator of claim 2, wherein the bias circuit comprises:

a current mirror circuit, having a first current path coupled to the second comparing result, and a second current path; and a third transistor, having a control end, a first end coupled to the supply voltage, and a second end coupled to the control end of the third transistor, the second current path of the current mirror circuit, and the control end of the second transistor.

6. The voltage regulator of claim 1, being a low dropout (LDO) regulator.

7. A voltage regulating method, comprising:

comparing a first reference voltage with a feedback voltage that is generated at a node of a resistor network to generate a first comparing result accordingly;

utilizing a first transistor to control an output voltage at an output node in response to the first comparing result;

utilizing a second transistor to adjust the output voltage at the output node in response to a control signal;

providing the feedback voltage according to the output voltage; and providing the control signal according to the output voltage, comprising:

when the output voltage has a voltage drop, generating the control signal to control the second transistor to increase a voltage level of the output voltage for reducing the voltage drop only.

8. The voltage regulating method of claim 1, wherein the step of providing the control signal according to the output voltage comprises:

comparing the output voltage with a second reference voltage to generate a second comparing result; and providing the control signal to the second transistor according to the second comparing result.

9. The voltage regulating method of claim 7, wherein the step of providing the control signal according to the output voltage comprises:

utilizing a current mirroring manner to generate the control signal according to the output voltage.

10. A voltage regulator, comprising:

a voltage regulating circuit, for regulating an output voltage at an output node according to a feedback voltage derived from the output voltage; and a compensation block, coupled to the output node of the voltage regulating circuit, for receiving the output voltage and selectively compensating the output voltage according to the output voltage, wherein the compensation block comprises:

a first transistor, having a control end for receiving a control signal, a first end coupled to a supply voltage, and a second end coupled to the output node, wherein the first transistor adjusts the output voltage at the output node in response to the control signal;

a comparator, having a first end for receiving a reference voltage and a second end coupled to the output node, the comparator comparing the output voltage with the reference voltage to generate a comparing result, comprising:

a current source, for providing a reference current;

a second transistor, having a control end for receiving the output voltage, a first end coupled to the current source, and a second end coupled to the bias circuit;

a third transistor, having a control end for receiving the reference voltage, a first end coupled to the first end of the second transistor, and a second end; and a first current mirror circuit, having a first current path coupled to the second end of the second transistor and a second current path coupled to the second end of the third transistor; and a bias circuit, coupled to the comparator and the first transistor, for providing the control signal to the first transistor according to the comparing result.

11. The voltage regulator of claim 10, wherein the compensation block is active when the output voltage has a voltage drop.

12. The voltage regulator of claim 10, wherein the bias circuit comprises:

a second current mirror circuit, having a first current path coupled to the second end of the second transistor, and a second current path; and a fourth transistor, having a control end, a first end coupled to the supply voltage, and a second end coupled to the control end of the fourth transistor, the second current path of the second current mirror circuit, and the control end of the first transistor.

13. The voltage regulator of claim 10, wherein the bias circuit comprises:

a current mirror circuit, having a first current path coupled to the second comparing result, and a second current path; and a second transistor, having a control end, a first end coupled to the supply voltage, and a second end coupled to the control end of the second transistor, the second current path of the current mirror circuit, and the control end of the first transistor.

* * * * *